United States Patent [19]

Young

[11] Patent Number: 5,044,097

[45] Date of Patent: Sep. 3, 1991

[54] PROTECTIVE COVERING DEVICE FOR THE HEEL OF A LADIES SHOE

[76] Inventor: Lori S. Young, 49 Home Street, Winnipeg, Manitoba, Canada, R3G 1W7

[21] Appl. No.: 484,868

[22] Filed: Feb. 26, 1990

[51] Int. Cl.[5] ..... A43B 23/20

[52] U.S. Cl. ..... 36/72 B; 36/72 R

[58] Field of Search ..... 36/72 R, 72 B, 7.1 R, 36/7.3

[56] References Cited

U.S. PATENT DOCUMENTS

| | | | |
|---|---|---|---|
| 1,828,246 | 10/1931 | Destro | 36/72 B |
| 1,945,420 | 1/1934 | Charles | 36/72 B |
| 3,153,289 | 10/1964 | Martin | 36/72 B |
| 3,217,430 | 11/1965 | Novick | 36/72 B |
| 4,727,659 | 3/1988 | Walker | 36/72 B |
| 4,785,556 | 11/1988 | Blair | 36/7.1 R |

FOREIGN PATENT DOCUMENTS

| | | | |
|---|---|---|---|
| 1263055 | 4/1961 | France | 36/72 B |
| 2478439 | 9/1981 | France | 36/72 B |
| 717083 | 10/1966 | Italy | 36/72 B |
| 2190823 | 12/1987 | United Kingdom | 36/72 B |
| 2195228 | 4/1988 | United Kingdom | 36/72 B |
| 2214053 | 8/1989 | United Kingdom | 36/72 B |

*Primary Examiner*—Steven N. Meyers

*Attorney, Agent, or Firm*—Adrian D. Battison; Stanley G. Ade; Murray E. Thrift

[57] ABSTRACT

A protective covering device for the heel of a ladies shoe comprises integrally molded body formed from an elastic material such as latex and has a generally conical portion into which the heel of the shoe is inserted together with an upper portion which wraps around the heel part of the upper of the shoe. The elastic effect of the material when stretched over the shoe causes sufficient adhesion to remain attached to the shoe. The conical heel portion has a plurality of convolutions surrounding the heel which allow the heel portion to expand or be compressed to accommodate different heel heights.

8 Claims, 2 Drawing Sheets

PROTECTIVE COVERING DEVICE FOR THE HEEL OF A LADIES SHOE

BACKGROUND OF THE INVENTION

This invention relates to a protective covering device for the heel of a ladies shoe for use when the shoe heel is in danger of being scuffed for example in driving in which the back of the heel and heel portion of the upper tend to rest against the floor of the automobile as the toe is lifted away from the floor for operating the vehicle pedals.

It is well known that significant damage occurs to the heel of ladies shoes when driving since the back of the heel must rest on the floor of the automobile while the pedals are operated. This problem is particularly noted in shoes with higher heels and these shoes are delicate and prone to damage when the floor becomes covered with grit or other material carried into the vehicle on the shoes of the wearer. Some ladies go the extent of carrying a separate pair of shoes used solely for driving so the shoes are kept in the car and worn to replace the outdoor shoes while driving. Others remove the shoes altogether and drive without shoes but this is of course a dangerous action since it tends to alter the feel of the pedals.

Various proposals for heel covering devices have been made previously and attention is particularly directed to U.S. Pat. Nos. 3,153,289 (Martin); 3,025,617 (Rizzonelli); 2,915,836 (McDonough); 4,461,100 (Minor); and 3,104,479 (D'Amico) all of which disclose sleeve type arrangements slipped over the heel of the ladies shoe to engage around the rear of the heel portion of the upper.

Attention is also directed to U.S. Pat. Nos. 1,828,246 (Destro); 4,785,556 (Blair); 3,066,427 (Matthews); 3,239,953 (Norton); 4,262,048 (Mitchell); 4,441,264 (Gubias); 3,851,412 (Boegele); 4,498,252 (Connors); 3,217,430 (Novick); 4,249,321 (Nagy); 3,095,659 (McClellan); and Canadian Patents 196,312 (Poore); and 68519 (Morrow) all of which disclose a device which is strapped onto the shoe in the area of the heel to attempt to protect the heel area.

British Patent 275019 discloses a cup-shaped body which has an opening through which the heel passes and which clamps elastically onto the rear of the heel of the wearer.

These devices however have been generally unsuccessful and have not been widely accepted. Other products are available on the market place and one product comprises merely a sewn sleeve of a water resistant fabric which has an elasticated opening at one end and a strap at the other end. This device is however entirely unsatisfactory since the heel slips through the elasticated end and is left exposed for further damage.

SUMMARY OF THE INVENTION

It is one object the present invention, therefore, to provide an improved device which can be attached to the heel of a ladies shoe to provide protection for the heel during driving.

According to the invention, therefore, there is provided a protective covering device for the heel of a ladies shoe, the shoe comprising an upper defining a toe covering portion and a heel cupping portion arranged to extend around the heel of the wearer, a sole, and a heel projecting downwardly from the heel cupping portion of the upper, the device comprising a unitary integrally molded body formed from an elastic material and having a heel engaging portion shaped to wrap around the heel and an upper portion connected to an upper edge of the heel engaging portion so as to extend upwardly therefrom to engage around at least a part of the heel cupping portion so that a rear edge of the device extends from the tip of the heel to a position on the upper between the top of the heel and an upper edge of the upper at the rear of the heel, the heel engaging portion comprising wall shaped to substantially surround the heel and extending from said upper end having an open mouth connected to said upper portion to a lower end which is reduced in transverse dimension relative to the open mouth, the wall converging in transverse dimension from said open mouth to said lower end in a plurality of steps so as to define at least three portions of the wall each of which forms a band surround the heel and each of which is reduced in transverse dimension relative to the next adjacent portion which lies closer to the open mouth, the wall being flexible between the bands to allow compression and expansion of the heel engaging portion in a longitudinal direction.

The device therefore comprises simply an integrally molded body which attaches to the shoe by the adhesive effect of the elastic material stretched over the heel area. It is therefore simply attached, simply removed and of a construction which can be readily washed and stored for further use.

The heel protector is molded to form to the shape of the back and the immediate sides of the shoe, adhering by friction and as a result of the nature of the material used. It is molded to generally fit high heeled women's shoes. However the convolutions or band portions enable the device to be adjustable in height to conform to various heel sizes and with adjusting width to varying degrees depending upon the material used for construction.

The adjustability portion of the heel protector is achieved by molding the part that fits over the heel in the series of bands, which also renders this part of the device collapsible and hence easy to carry. The design of the adjustable portion fitting over the heel may be arranged in several different ways.

The part of the device covering the heel may be continuous hollow tube or a three side construction. If the latter, the open side occurs at the inside front of the heel allowing the device to be more accepting of wider heels.

The heel protector is intended to be constructed in a single piece from a flexible rubber or plastics material making it easy to slip on and to clean.

According to a second aspect of the invention there is provided a combination of a ladies shoe and a protective covering device for the heel thereof, the shoe comprising an upper defining a toe covering portion and a heel cupping portion arranged to extend around the heel of the wearer, a sole, and a heel projecting downwardly from the heel cupping portion of the upper, the device comprising a unitary integrally molded body formed from an elastic material and having a heel engaging portion wrapped around the heel and an upper portion connected to an upper edge of the heel engaging portion so as to extend upwardly therefrom and engaging around at least a part of the heel cupping portion so that a rear edge of the device extends from the tip of the heel to a position on the upper between the top of the heel and an upper edge of the upper at the rear of the heel, the heel engaging portion comprising a wall shaped to substantially surround the heel and extending from said upper end having an open mouth connected to said upper portion to a lower end which is reduced in transverse dimension relative to the open mouth, the wall converging in transverse dimension from said open mouth to said lower end in a plurality of steps so as to define at least three portions of the wall each of which forms a band surrounding the heel and each of which is reduced in transverse dimension relative to the next adjacent portion which lies closer to the open mouth, the wall being flexible between the bands to allow compression and expansion of the heel engaging portion in a longitudinal direction.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which:

DESCRIPTION OF THE DRAWINGS:

In the drawings like characters of reference indicate corresponding parts in the different figures.

DETAILED DESCRIPTION

Figure 4:
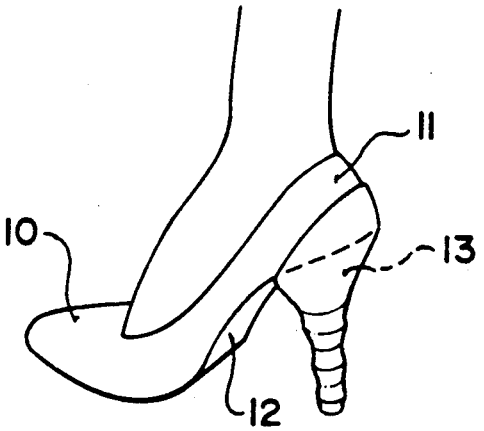
FIG. 4 is an isometric view of a shoe to which a device has been attached.
Figure 5:
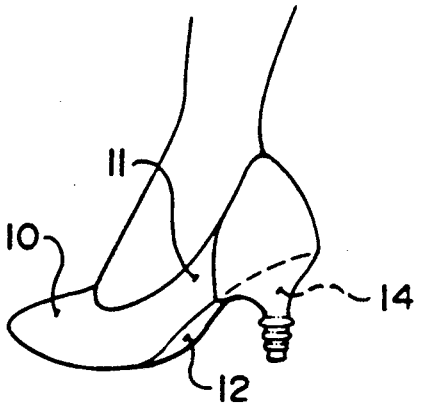
FIG. 5 is an isometric view of an alternative shoe to which the device has been attached.

In FIGS. 4 and 5 are shown shoes of conventional structure including an upper 10 having a portion which extends over and around the toes of the wearer and a heel portion 11 which extends around the heel of the wearer. The upper is attached in conventional manner to a sole 12. Under the heel portion is provided a heel. In FIG. 4, the heel is indicated at 13 and is of a larger height and of a very narrow tip of the type conventionally known as a "stilleto" heel. In FIG. 5 is shown a heel similarly of a small tip size but of a smaller height.

Figure 3:
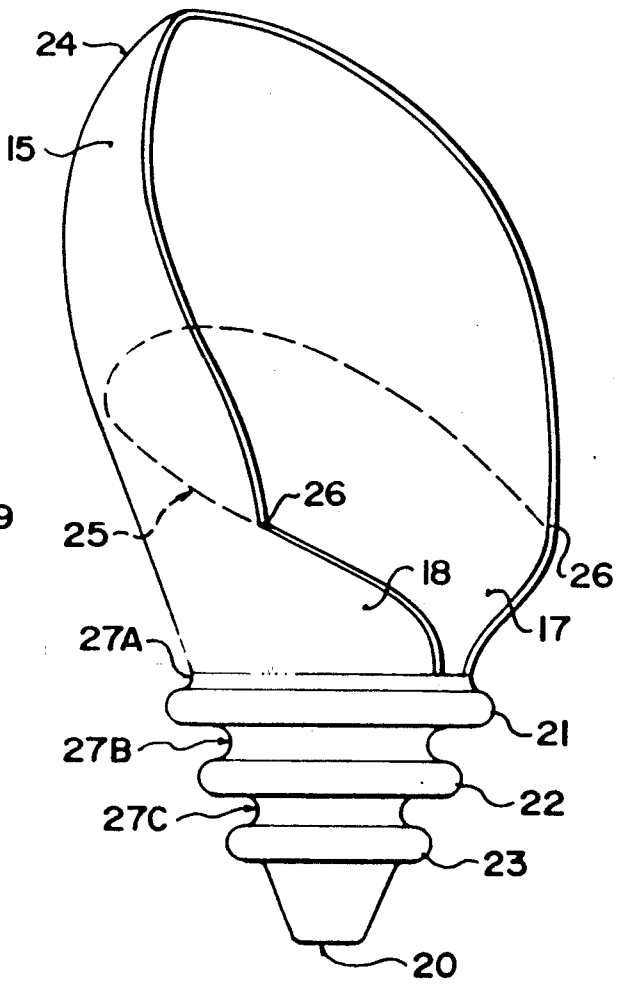
FIG. 3 is an isometric view of the device of FIG. 1.
Figure 2:
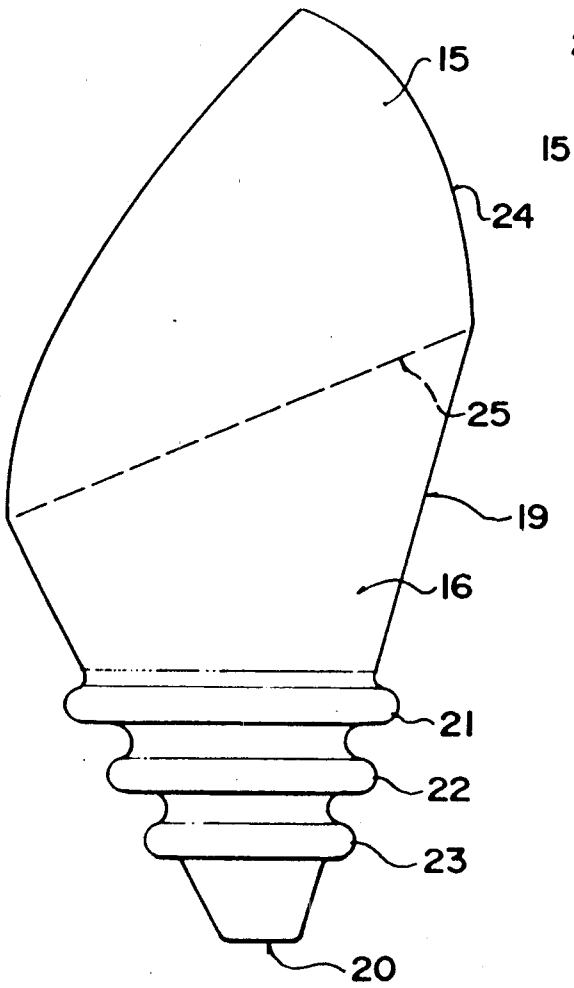
FIG. 2 is a side elevational view of the device of FIG. 1.
Figure 1:
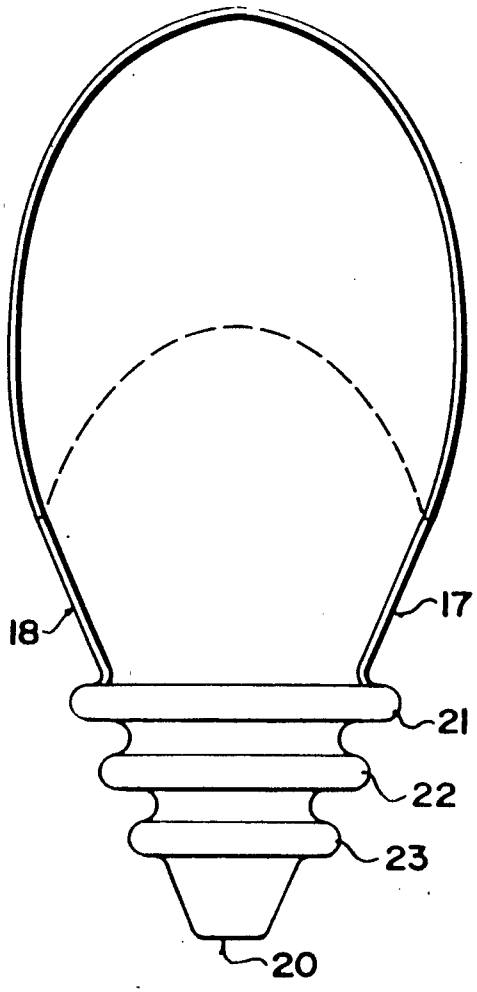
FIG. 1 is a front elevational view of a device according to the present invention.

Turning now to FIGS. 1 to 3, the device according to the invention includes an upper portion 15 and a heel covering or engaging portion 16 which are integrally formed by molding from a suitable elastic material such as a latex or rubber material. The heel covering portion is generally conical in shape having converging side walls 17 and 18 and a rear wall 19. The apex of the conical shape is indicated at 20 and has a flat truncated lower most surface dimensioned to receive the tip of a heel.

Partway along the walls 17, 18 and 19 is provided three convoluted or concertina sections 21, 22 and 23 each of which extends out from the wall to form a rib surrounding the whole of the heel portion. In between the ribs, the wall curves inwardly so that the concertina sections can compress or expand in conventional manner. These inward portions identified at 27A, 27B, 27 form bands surrounding the heel each of which is reduced in transverse dimension relative to the previous band which lies closer to the open mouth of the heel engaging portion. As shown in FIG. 1, a front wall is open down to the first rib 21 and from that point downwardly to the lowermost surface 20, the wall is closed so that it fully surrounds the heel when inserted. The upper portion 15 is shaped to cup around the heel of the wearer so that a rear edge 24 is smoothly curved to follow the curvature of the heel of the shoe at the upper. In addition a base section of the upper portion 15 as best shown in FIG. 3 curves in an imaginary line 25 forming an open mount of the heel engaging portion from an uppermost edge of the sidewalls 17 and 18 indicated at 26 around the heel of the user at the junction between the upper and the heel.

The device is thus of a very small size which does not include any straps or similar additional pieces and hence, when manufactured from a water resistant material such as latex can be easily washed and kept in a relatively clean condition.

The device is attached to the shoe of the wearer simply by stretching the device gently over the heel so that its elastic effect pulls it back onto the heel at the area of the upper and the heel portion so that it is held in place by the friction generated between the elastic material and the shoe itself and by the clamping effect of the elastic material wrapping around the shoe. The clamping effect occurs particularly at one or more of the bands 27A, 27B, 27C depending upon the size of the heel of the shoe.

In FIG. 4 the device is shown as more stretched in view of the extra length of the heel. In this case the upper edge of the device may not reach as high on the heel of the shoe as for example as shown in FIG. 5 which has a lower heel height and therefore the convolutions are not so stretched. In a yet further arrangement (not shown) a heel of a shoe can be of the wider type which is generally lower and possibly even lower than the heel of FIG. 5. In such a case the heel presses into one of the convolutions 21, 22 or 23 with the lower part of the heel portion of the device beyond that part being compressed up to a position adjacent the underside of the heel of the shoe. This can also cause stretching of the heel portion in a width direction and this is accommodated by stretching of the inner parts of the convolution toward the outer parts of the convolutions.

Figure 6:
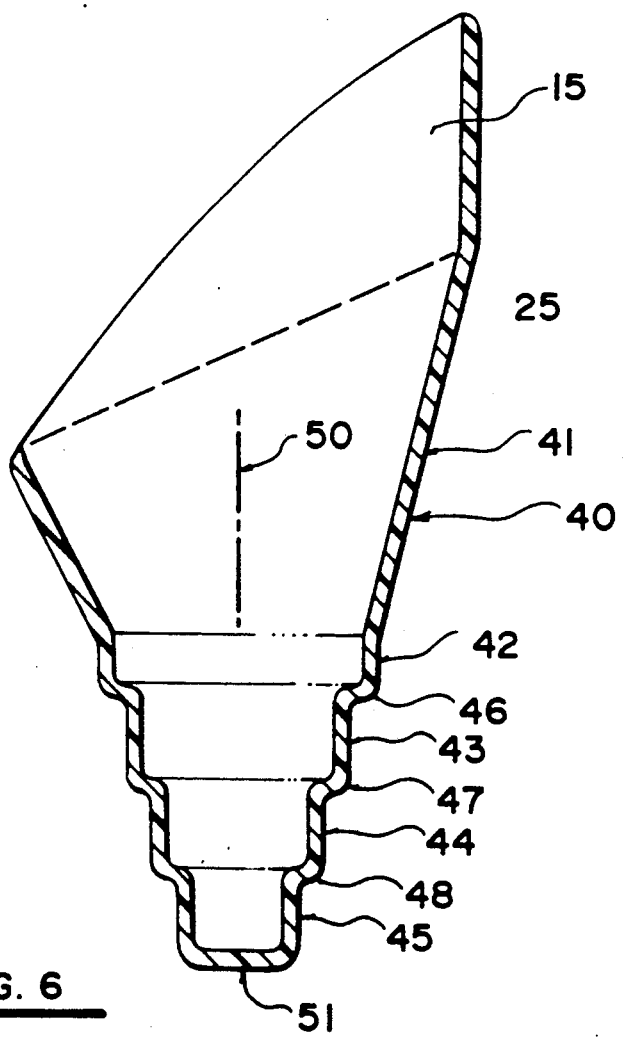
FIG. 6 is a transverse cross-section view of an alternative arrangement of a device according to the invention.

Turning now to FIGS. 6 there is shown a modified arrangement which includes a heel engaging portion generally indicated at 40 and an upper portion 15 similar to the previously described upper portion. The heel engaging portion in this embodiment includes a first frustoconical portion 41, a plurality of band portions 42, 43, 44 and 45 and a plurality of interconnecting portions 46, 47 and 48. The band portions 42, 43, 44 and 45 each are annular in shape with a peripheral wall which lies parallel to a longitudinal axis 50 of the heel portion. The integrating portions turn inwardly substantially at right angles so the bands and connecting portions form effectively a series of right angle steps and a lowermost closed portion defined by the band 45 and an end face 51.

The device as shown in FIG. 6 operates substantially as previously described in that one or more of the bands can engage around the periphery of the heel of the shoe in a clamping action with the remaining bands beneath the end of the heel in the case of a wider heel being compressible against the underside of the heel. When used with a stilleto type heel, the stilleto type heel extends into the lowermost portion defined by the band 45 and the end face 51 which is closed which is a transverse width of the order of the ½ inch so as to elastically engage or stretch around the end of the heel. The longitudinal adjustment can therefore take place as previously described and in addition the clamping action mainly occurs in view of the clamping of the bands around the heel with further gripping being provided by the elastic effect of the upper part of the device. No further attachment or mechanism is necessary or provided.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A combination of a ladies shoe and a protective covering device for the heel thereof, the shoe comprising an upper defining a toe covering portion and a heel cupping portion arranged to extend around the heel of the wearer, a sole, and a heel projecting downwardly from the heel cupping portion of the upper, the device comprising a unitary integrally molded body formed from an elastic material and having a heel engaging portion wrapped around the heel and an upper portion connected to an upper edge of the heel engaging portion so as to extend upwardly therefrom and engaging around at least a part of the heel cupping portion so that a rear edge of the device extends from the top of the heel to a position on the upper between the top of the heel and an upper edge of the upper at the rear of the heel, the hell engaging portion comprising a wall shaped to substantially surround the heel and extending from said upper end having an open mouth connected to said upper portion to a lower end which is reduced in transverse dimension relative to the open mouth, the wall converging in transverse dimension from said open mouth to said lower end in a plurality of steps so as to define at least three portions of the wall each of which forms a band surrounding the heel and each of which is reduced in transverse dimension relative to the next adjacent portion which lies closer to the open mouth, the bands being shaped and dimensioned relative to the heel such that at least two of the bands are stretched around the heel into contact with the heel at a cooperating band portion of the heel with the band portion being spaced along the length of the heel, the wall between the bands being flexible and spaced from the heel to allow compression and expansion of the heel engaging portion in a longitudinal direction.

2. The invention according to claim 1 wherein the device is attached to the heel of the shoe by the adhesive effect obtained by stretching the elastic material into place on the heel.

3. The invention according to claim 1 wherein the lower end of the heel engaging portion is substantially closed and wherein it is sized in transverse dimension to receive a stilleto type heel of the ladies shoe.

4. The invention according to claim 3 wherein the transverse dimension of the lower end is of the order of 0.5 inches.

5. The invention according to claim 1 wherein an upper edge of the upper portion extends forwardly and downwardly from a position at the rear of the heel cupping portion to connect with a forwardmost edge of the heel engaging portion.

6. The invention according to claim 1 wherein the bands each comprise an annular portion with a peripheral wall of the band lying parallel to a longitudinal axis of the heel engaging portion.

7. The invention according to claim 6 wherein there is provided a plurality of portions each interconnecting one of the bands to a next adjacent band, and interconnecting portions lying substantially at right angles to the respective bands.

8. The invention according to claim 1 wherein an upper part of the heel engaging portion is substantially frustoconically shaped so as to converge from said upper portion to a first of the bands.

* * * * *